US005706625A

United States Patent [19]

Vallance et al.

[11] Patent Number: 5,706,625

[45] Date of Patent: Jan. 13, 1998

[54] SUPPORTLESS DASHER BOARD

[75] Inventors: Douglas Vallance, Fergus; Brian Townsend, Mississauga, both of Canada

[73] Assignee: Crystaplex Arenas, Mississauga, Canada

[21] Appl. No.: 610,420

[22] Filed: Mar. 4, 1996

[51] Int. Cl.[6] ..... E04H 17/16

[52] U.S. Cl. ..... 52/766; 52/127.11; 52/204.64; 52/584.1; 52/775; 52/800.18; 256/24; 403/374; 472/94; 473/490

[58] Field of Search ..... 52/36.1, 127.7, 52/127.8, 127.9, 127.11, 204.64, 204.65, 204.69, 204.71, 239, 582.2, 584.1, 767, 766, 773, 775, 780, 800.12, 800.18; 256/24, 26; 403/373, 374; 472/92, 94; 473/415, 421, 473, 490, 132, 212

[56] References Cited

U.S. PATENT DOCUMENTS

| | | | |
|---|---|---|---|
| 985,800 | 3/1911 | Hartbauer | 52/775 X |
| 1,230,758 | 6/1917 | Murnane | 52/767 |
| 1,687,305 | 10/1928 | Nelson . | |
| 2,026,138 | 12/1935 | Naisuler | 52/766 |
| 2,026,139 | 12/1935 | Naisuler et al. . | |
| 2,781,558 | 2/1957 | Tarzia | 52/239 X |
| 3,254,461 | 6/1966 | White et al. | 52/775 X |
| 3,296,763 | 1/1967 | Curl . | |
| 3,465,488 | 9/1969 | Miller | 52/481.1 |
| 3,675,382 | 7/1972 | Lickliter et al. | 52/239 X |
| 3,727,888 | 4/1973 | Nickolas . | |
| 3,844,539 | 10/1974 | Abbott | 472/94 X |
| 3,883,120 | 5/1975 | Tippmann | 256/24 |
| 4,779,919 | 10/1988 | Muller | 52/766 X |
| 4,883,267 | 11/1989 | Burley . | |
| 4,905,970 | 3/1990 | Holmsten et al. . | |
| 4,914,888 | 4/1990 | Hanson . | |

FOREIGN PATENT DOCUMENTS

| | | | |
|---|---|---|---|
| 2669834 | 6/1992 | France | 472/94 |

*Primary Examiner*—Carl D. Friedman
*Assistant Examiner*—Kevin D. Wilkens
*Attorney, Agent, or Firm*—Greenberg, Traurig, Hoffman, Lipoff, Rosen & Quentel, P.A.

[57] ABSTRACT

A dasher board assembly having a U-shaped channel for receiving a shielding panel, and a rotatable cam co-operating with the channel to releasably clamp the shielding panel to the channel.

15 Claims, 7 Drawing Sheets

SUPPORTLESS DASHER BOARD

FIELD OF INVENTION

This invention relates to a dasher board assembly and particularly relates to a dasher board assembly having a U-shaped channel for receiving a shielding panel and a rotatable cam hidden from view which co-operates with said channel to releasably clamp said shielding panel to the channel.

BACKGROUND OF THE INVENTION

Wall enclosures around athletic playing surfaces have heretofore been very popular, whether such wall enclosures define ice rinks, soccer fields, or the like.

Such wall enclosures have, in the past, been constructed of a variety of materials, including wooden frame members, which have been found to be undesirable since the wooden frame members are subject to damage due to moisture and temperature extremes in the case of outdoor rinks, as well as being costly to construct, particularly on site.

Accordingly, a number of interconnected dasher board panels suitable for ice hockey rinks, skating rinks and soccer fields have heretofore been proposed.

For example, U.S. Pat. No. 4,905,970 teaches a dasher board system for athletic playing surfaces which includes inter-connected substantially identical dasher board sections employing in one embodiment a polyethylene facing panel backed by a plywood panel, supported by upright tubing sections anchored to perimeter concrete.

Moreover, U.S. Pat. No. 3,727,888 teaches a hockey rink board having panel sections standing end-to-end to form a wall around a hockey rink or the like where each panel has a central post for holding it upright and for pivoting it into alignment with similar panels to form a wall.

Moreover, U.S. Pat. No. 4,883,267 teaches an ice rink dasher board system having an adjustable shock absorbing mechanism for providing a desired degree of resiliency of the dasher board panels.

Moreover, U.S. Pat. No. 3,883,120 also shows a dasher board for skating rinks made entirely of fibreglass and having a smooth front portion with integrally formed border and a plurality of bolsters to provide rigidity.

These and other dasher board systems present relatively complicated structures. Moreover, many of the dasher board systems used heretofore present exposed clamping mechanisms such as bolts or the like, in order to clamp the shielding panels such as tempered glass or the like to the dasher board assemblies.

Furthermore, a number of clamping mechanisms have heretofore been proposed in order to clamp panels of glass.

For example, U.S. Pat. No. 4,914,888 teaches a support frame for receiving and retaining a panel of glass as part of a wall or door assembly.

Moreover, U.S. Pat. No. 2,026,139 shows a mounting for a glass pane having a front clamping member, a back clamping member and a cam on the back clamping member co-acting with the front clamping member to draw the members towards each other into glass clamping relation.

Finally, U.S. Pat. No. 3,296,763 illustrates devices for removably locking panels in a framing.

It is an object of this invention to provide an improved dasher board system which is easy to construct and assemble. It is also an object of this invention to provide an improved clamping mechanism of the shielding panel which is hidden from view.

The broadest aspect of this invention relates to a dasher board assembly having a channel for receiving a shielding panel, and a rotatable cam co-operating with the channel to releasably clamp the shielding panel to the channel.

Another aspect of this invention relates to a dasher board assembly including: a lower frame having a bottom plate adapted to be anchored to the ground, a pair of spaced apart stringers at the upper end of the lower frame, the stringers including an upper and lower surface; a plurality of upstanding posts, each having a lower end connected to the bottom plate, and an upper end connected to said lower surface of said stringer; a U-shaped channel disposed between the stringers, the U-shaped channel presenting a first leg connected to one of said stringers, and a second movable leg; a tempered glass or shielding panel adapted to be releasably secured to the U-shaped channel; a rotatable cam disposed between the second leg of the U-shaped channel and the other stringer for co-operating with the second leg of the channel to releasably clamp the tempered glass between the first and second legs; a sill connected to the upper surface of the stringers to prevent access to the rotatable cam.

DRAWINGS

These and other objects and features of the invention shall now be described in relation to the drawings.

Figure 2:
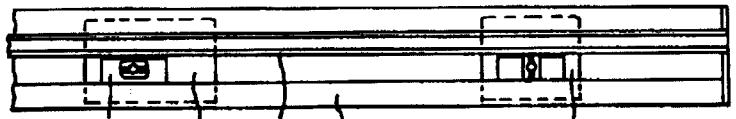
FIG. 2 is a partial top view of the dasher board assembly.
Figure 2A:
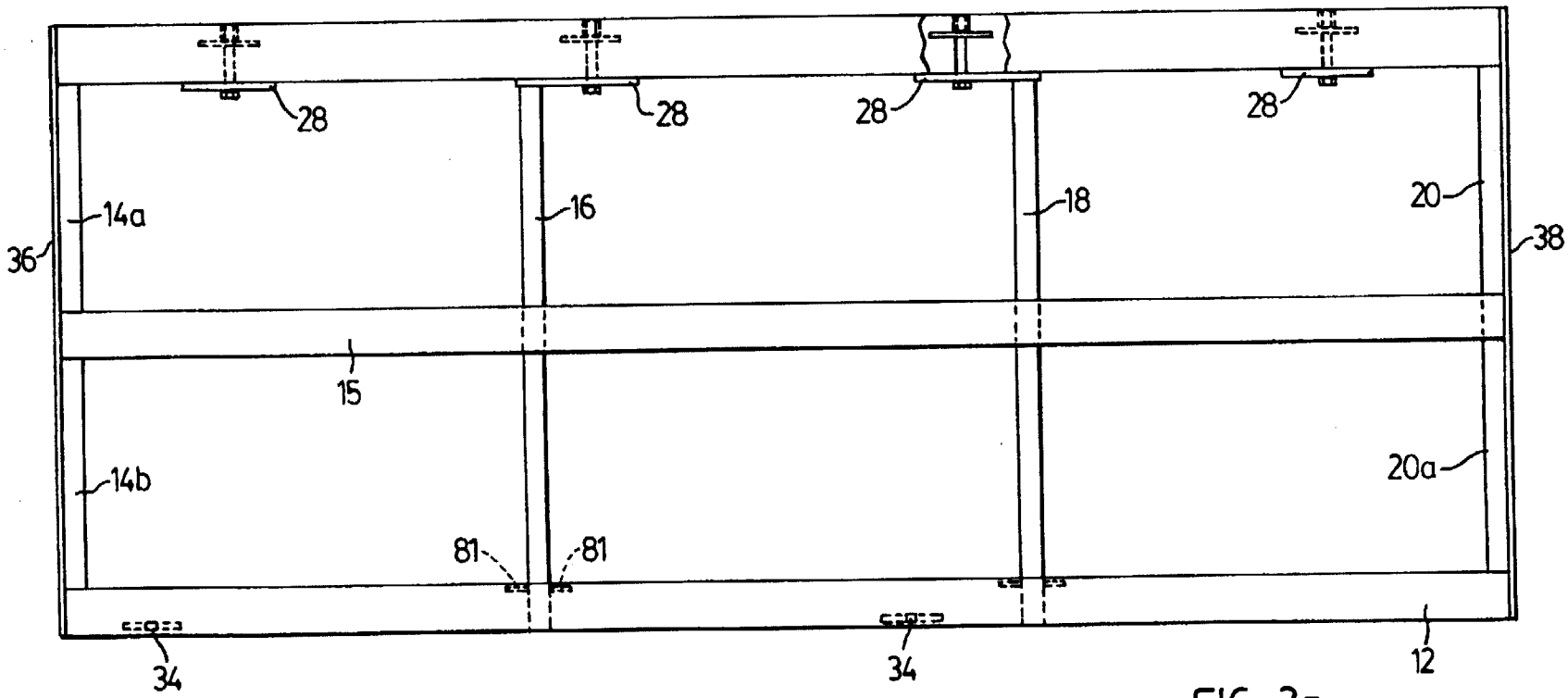

FIG. 2*a* is a front elevational view of the lower frame of the dasher board assembly.

Figure 3:
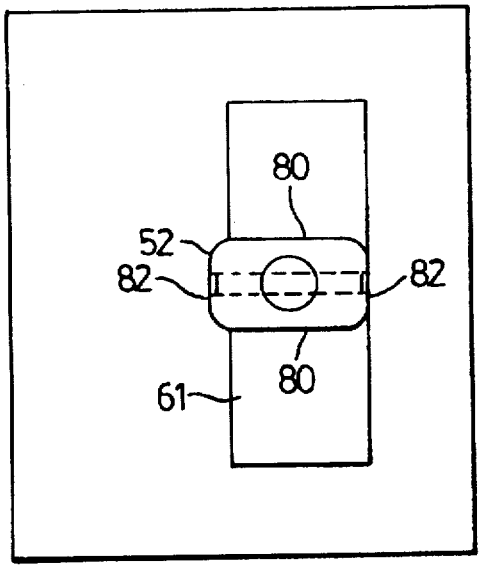

FIG. 3 is an expanded top view of the clamping mechanism.

Figure 4A:
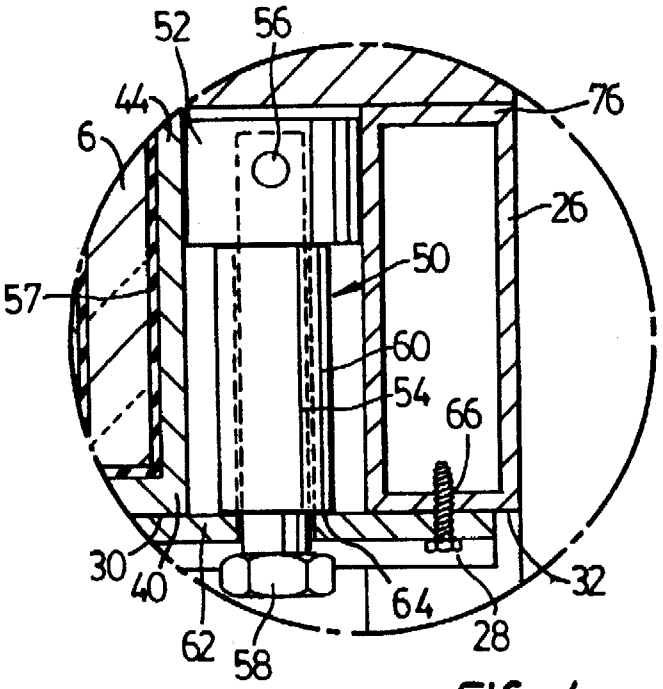
Figure 4:
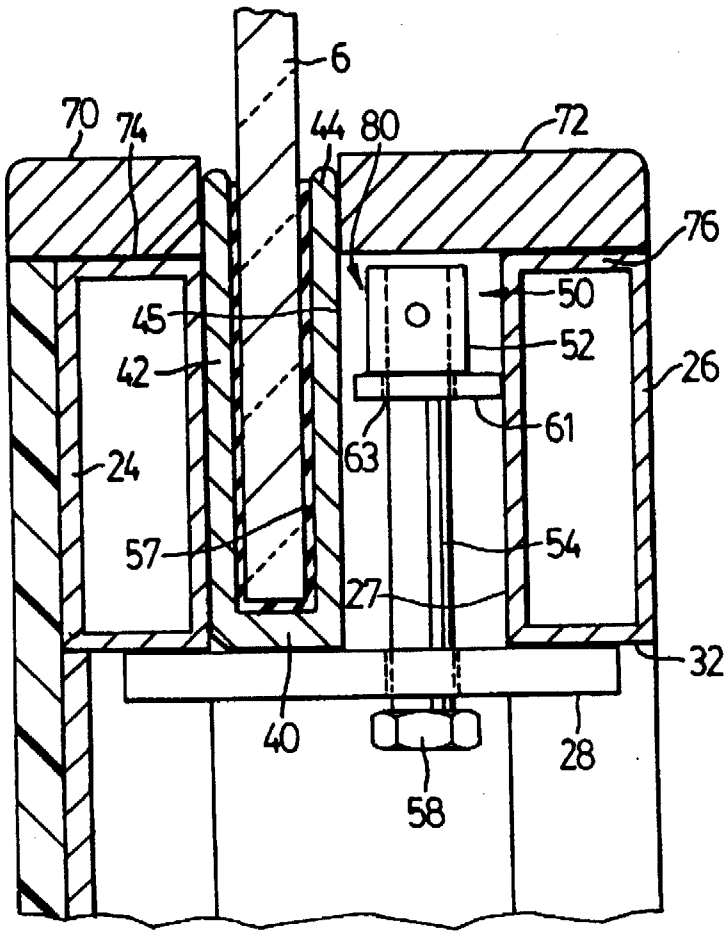

FIG. 4 is a front elevational view of one embodiment of the rotatable cam.

FIG. 4*a* is a front elevational view of another embodiment of the rotatable cam.

Figure 5:
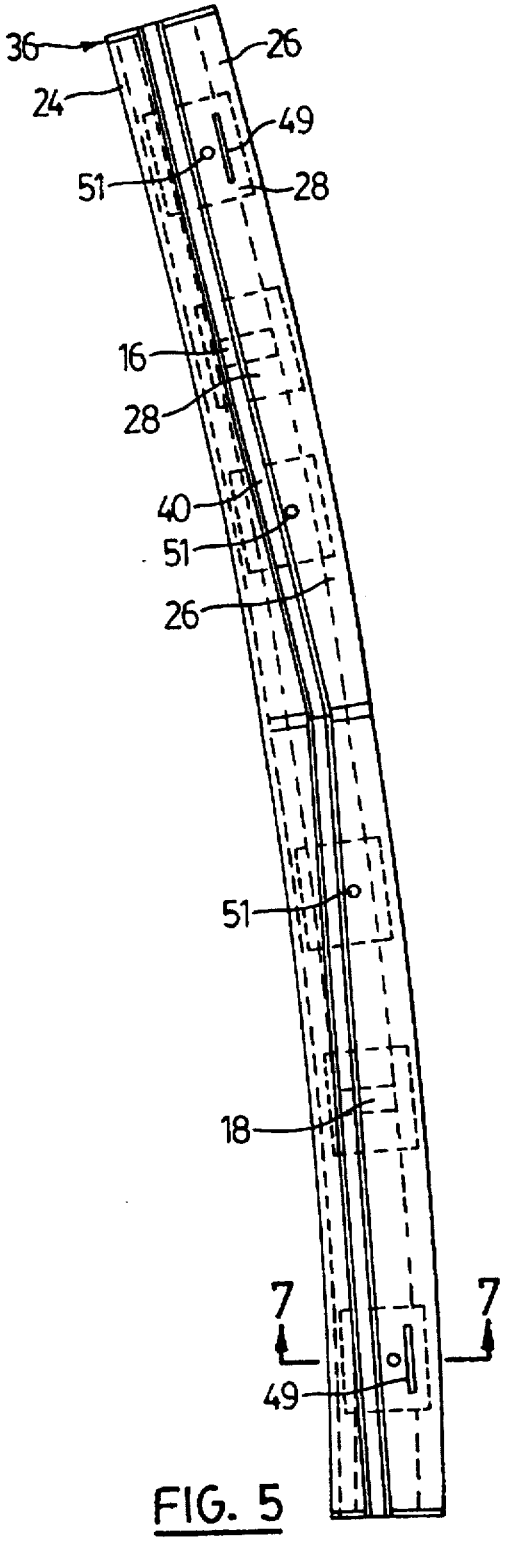

FIG. 5 is a top view of two sections of the dasher board system.

Figure 6A:
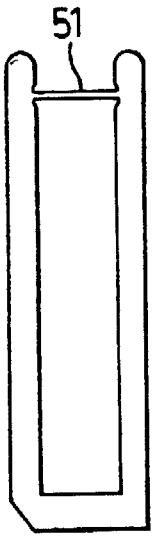
Figure 6:
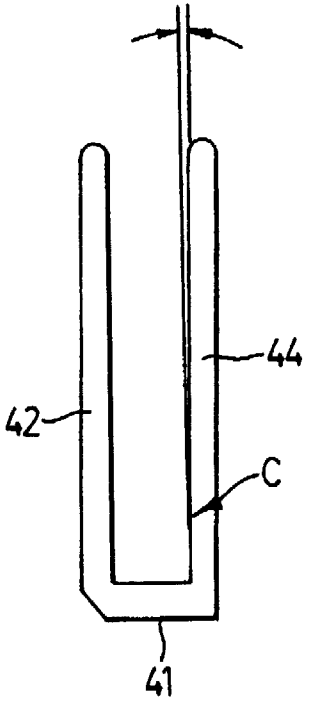

FIG. 6 is a side view of the U-shaped channel.

FIG. 6*a* is a side view of an extrusion of the U-shaped channel.

Figure 7:
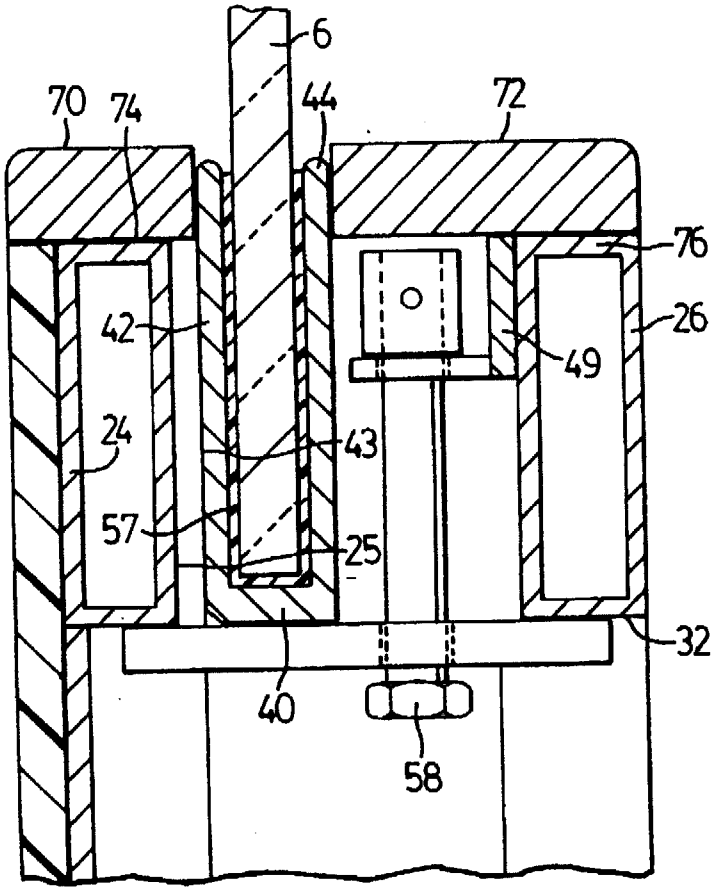

FIG. 7 is a cross sectional view taken along the lines 7—7 of FIG. 5.

Figure 8:
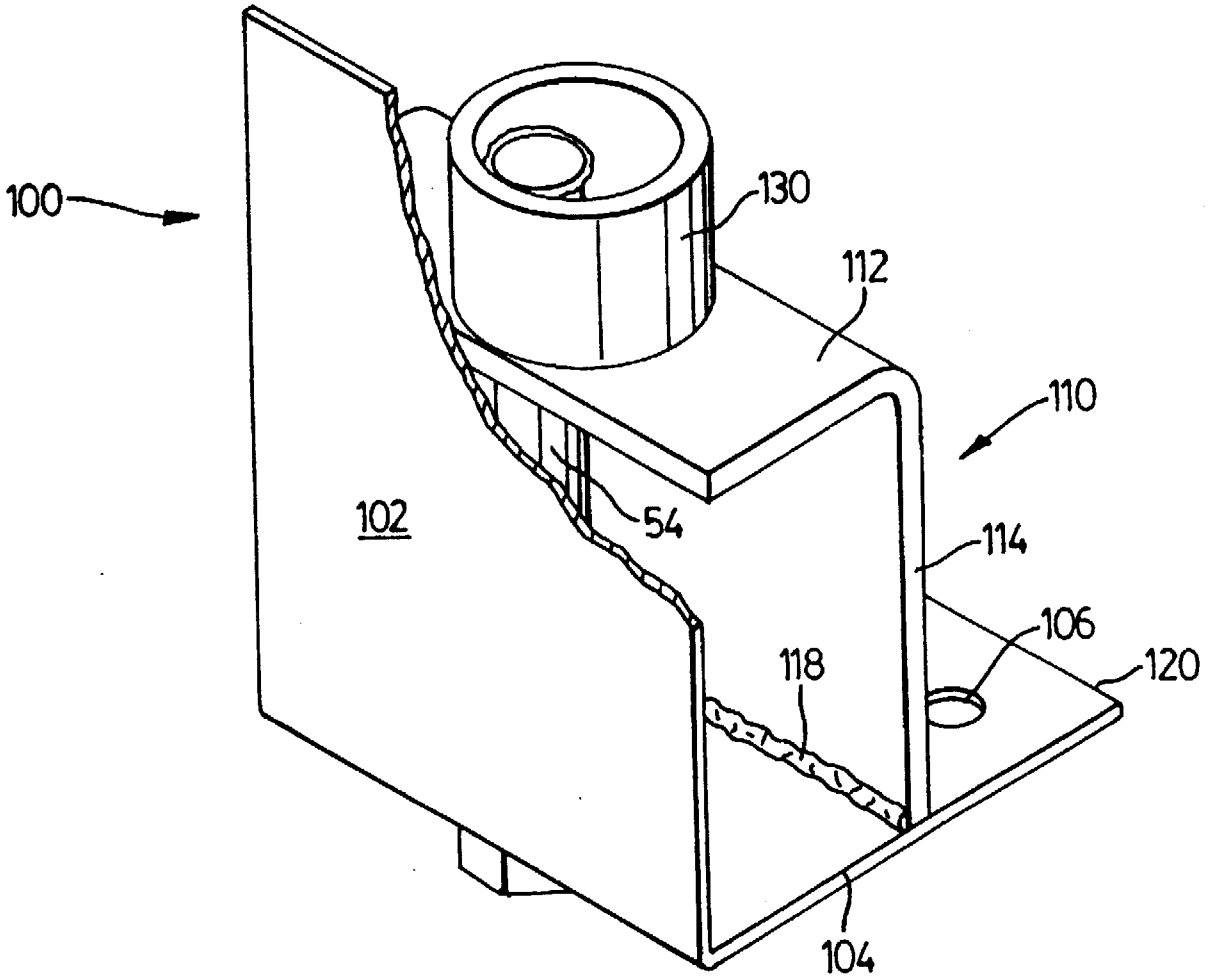

FIG. 8 is a perspective view of another embodiment of the rotatable cam.

Figure 9:
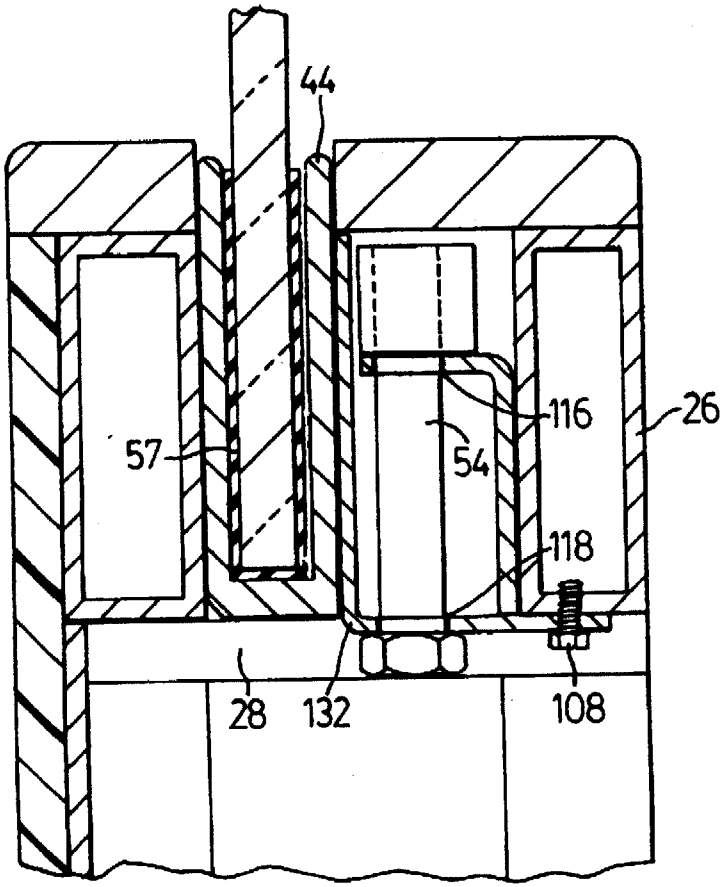

FIG. 9 is a partial cross sectional view of the rotatable cam of FIG. 8 in an unlocked position.

Figure 10:
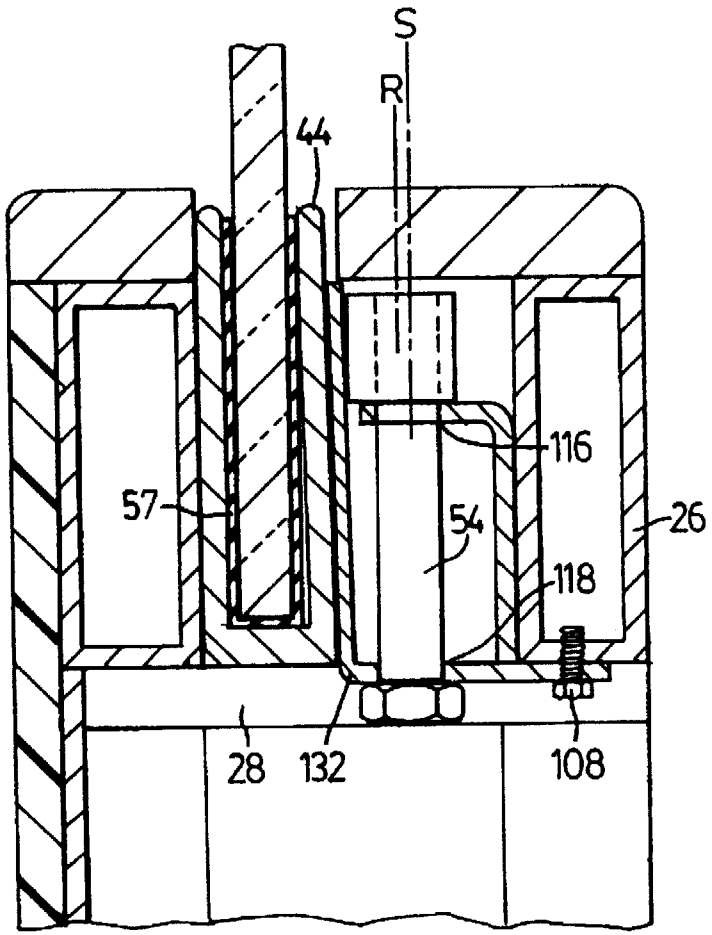

FIG. 10 is a partial cross sectional view of the rotatable cam of FIG. 8 in a locked position.

DESCRIPTION OF THE INVENTION

Like parts shall be given like numbers throughout the figures.

Figure 1:
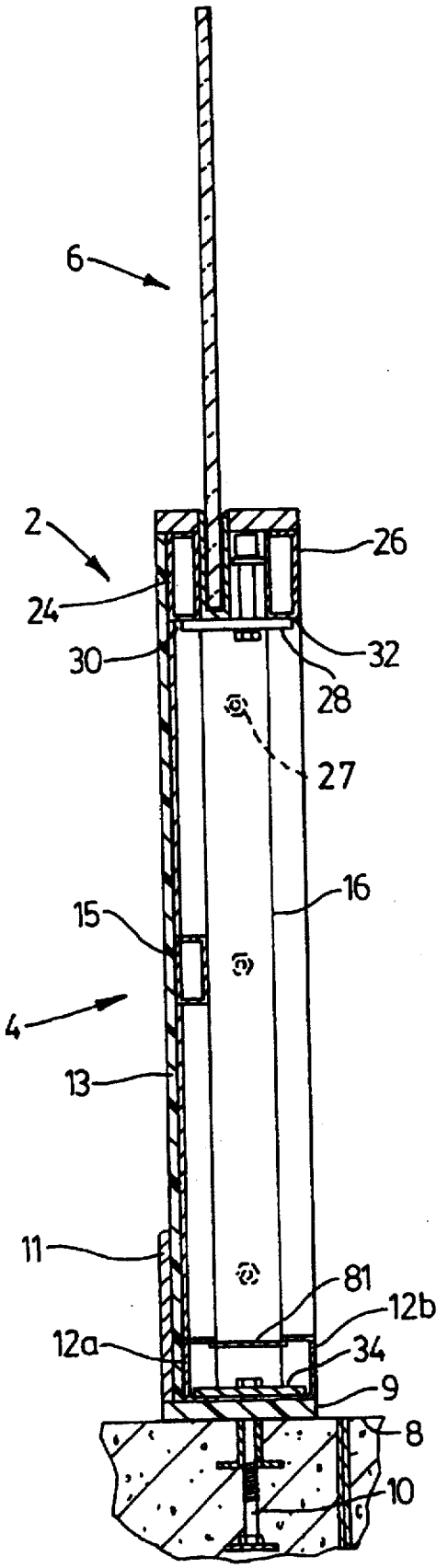
FIG. 1 is a side elevational view of the dasher board assembly.

FIG. 1 illustrates the dasher board assembly 2 having a lower frame assembly 4 and shielding panel, such as tempered glass, or the like, 6. Tempered glass utilized in hockey rinks can have a variety of appropriate thicknesses such as for example ⅝ of an inch thick.

The dasher board assemblies are anchored to the ground by means of bolts 10 as well as to each other in side-by-side relation so as to define a hockey rink or the like in a manner to be more fully described herein. The dasher board assembly 2 is supportless in the sense that adjacent vertical side edges of the tempered glass 6 are permitted to abut one against the other in a manner well known to persons skilled in the art.

In particular, the lower frame assembly 4 comprises a bottom channel 12 having a plurality of posts 16 and 18, whereby the lower ends of the posts 16 and 18 are connected or welded to the lower base plate or channel 12. The upper ends of the posts 16 and 18 are connected to the top stringers 24 and 26. In particular, the upper ends of the posts 16 and 18 are welded to flat plates 28 which in turn are welded to the bottom surface 30 and 32 of stringers 24 and 26. The stringers may be made from any suitable material such as for example out of aluminium tube or the like.

Although the size and configuration of the various components of the bottom frame can be varied within the spirit of the invention described herein, an example of the size and configurations of the various components shall now be given by way of example only without limiting the scope of the claims. The stringers 24 and 26 may be of any suitable size and for example are one and one-half inches by four inches by 3/16 of an inch thick aluminium. The flat plates 28 are also suitably sized and for example are one-half inch thick by five inches wide aluminium flat bar and can be eight inches long over the posts or six inches long between the posts. Alternatively flat plate 28 may be one piece.

For example, the bottom 12 may comprise of a pair **12*a* and 12*b* of one and one-half inches by three inches by ninety-five and one-quarter inches long aluminum channels welded to the posts. A kick strip 11 is also provided adding protection to the bottom of the dasher board 2** against skates or the like. The kick strip may be comprised of a variety of materials such as for example plastic.

Moreover, the bottom 12 includes a plurality of anchor plates 34 adapted to receive bolts 10 for anchoring the dasher board system 2 into the ground or concrete 8. A polyethylene ice dam 9 is provided between the concrete floor 8 and bottom channels **12*a* and 12*b*. The dasher board also includes a plastic panel 13 fastened to the stinger 24 intermediate stringer and channel 12*a***; and in one example the plastic panel is one-half inch thick, and is white with red and blue markings as may be found in a hockey arena.

The dasher board 2 also includes an intermediate stringer 15 welded to the posts 16 and 18 and in one example stringer 15 may be made from one and one-half inch by three inches by one-eight inch thick aluminium tube.

The dasher board 2 also includes plates **14*a*, 14*b* and 20 and 20*a* at each end which are welded to the stringers 24, 26 and 15. Plates 14*a*, 14*b*, 20 and 20*a* can be made from appropriate materials such as aluminium and in one example are 3/16 inch thick by one and one-half inches wide and fifteen inches long and are adapted for fastening panel 13**.

The dasher board system 2 also includes at the opposite sides thereof a plate 36 and 38 at each end thereof which are welded to the stringers 24 and 26 and bottom 12. By way of example the side plates 36 and 38 may be comprised of one-quarter inch thick aluminum plate at each end of the panel, having a plurality of holes 27 adapted to receive bolts or fastening means (not shown) so as to fastened adjacent side by side dasher board systems so as to define an athletic enclosure. The side plates of 36 and 38 include a slot adapted to receive the end of the tempered glass 6.

Although the material defined herein can be comprised of a variety of materials, aluminum has been found to be particularly useful in that it is lightweight and strong and may be easily welded and is given by way of example only without limiting the scope of the claims.

The flat plate 28 is welded to the bottom of the stringers 24 and 26 and U-shaped channel 40. The U-shaped channel 40 is adapted to receive the tempered glass 6.

In one embodiment, the U-shaped channel can be ninety-six inches long namely the same length as the panel 13 which is welded to one of the stringers 24 and flat plates 28.

With reference to FIG. 4, a pair of spaced apart stringers 24 and 26 are shown. Although the configuration of stringers 24 and 26 are shown to be rectangular in cross-section, and in one example comprise one and one-half inches by four inches by three-sixteenth inch aluminium tubes, a variety of materials or configurations can be utilized. A U-shaped channel 40 is disposed between the stringers 24 and 26. In particular, one leg 42 of the U-shaped channel 40 is connected or welded to one stringer 24 and accordingly is affixed thereto while the other leg 44 is adapted for movement in a manner to be more fully particularized herein. Leg 42 need not be connected or welded to stringer 24 since leg 42 may abut against stringer 24 as shown in FIG. 4. The U-shaped channel 40 is welded at the bottom to flat plates 28.

The particulars of the U-shaped channel are more fully described in FIG. 6 and **6*a*. The U-shaped channel 40 is designed so that one leg 44 is displaceable relative the leg 42 welded to stringer 24. In one embodiment the leg 42 is perpendicular to bottom 41 while leg 44 is at a very slight divergent angle relative to leg 42. In particular leg 44 is not parallel from point C and in one example leg 44 is at 0.89 of one degree divergent from the vertical angle measured from leg 42**.

FIG. **6*a* shows one manufacturing process to fabricate U-shaped channel 40 where an extrusion of a U-shaped channel includes a sacrificial leg 5 1 which is attached to legs 42 and 44 during the extrusion process. The sacrificial leg 51 is used to keep the legs in the appropriate position during extrusion and is adapted to be knocked off after extrusion in a manner so there is no protrusion of the knocked off sacrificial leg into the U-shaped channel. As an example the U-shaped channel shown in FIG. 6 and 6*a* is adapted to open 0.06 of an inch over a 4 inch height of leg 44. However other dimensions or arrangements could be used so long as the U-shaped channel has at least one leg 44 which is displaceable or adapted to move and pinch the lower end of the tempered glass 6. Although leg 42 is welded to stringer 24 in the embodiment shown, it is not necessary to weld same so long as bottom 41 is welded to plate 28 since leg 42 would bear against stringer 24 during pinching of the tempered glass 6**.

The U-shaped channel is adapted to receive one edge of shielding panel 6 such as tempered glass or the like which may be utilized at a hockey arena, skating rink, or soccer field or other athletic enclosure.

A selectively releasable bearing or pressure means such as a rotatable cam 50 is disposed between the second leg 44 of U-shaped channel 40 and stringer 26 which cooperates with the second leg 44 to releasably clamp the tempered glass 6 in a manner to be described.

A gasket 57 is utilized on both sides of the glass 6 within the U-shaped channel 40 to minimize any cracking or fracturing of tempered glass 6.

One embodiment of the rotatable cam 50 is shown in FIG. 4. The rotatable cam includes a cam head 52 which is secured to a threadless bolt or shaft 54 by means of a pin 56. The rotatable cam 50 is aligned within the space between the U-shaped bracket 40 and stringer 26 by means of a cam bracket 61 which is welded to stringer 26. The cam bracket 61 includes an aperture 63 for receiving threadless bolt 54.

Another embodiment of the rotatable cam 50 is shown in FIG. 4a which includes a cam head 52 which is secured to a bolt blank (no threads) 54 by means of a pin 56. The rotatable cam 50 includes a hex head 58 and a sleeve or pipe 60. The rotatable cam also includes a cam bracket 62 having a hole 64 adapted to receive the bolt 54. The screw holes 66 are also provided so as to screw the cam bracket 62 into the bottom surface 30 and 32 of stringers 24 and 26 as best shown in FIG. 4a. In the embodiment shown in FIG. 4a the flat plates 28 are welded to the bottom at stringers 24 and 26 while the cam bracket 62 is screwed to the stringers 24 and 26 between the flat plates 28.

The shape of the rotatable cam head 52 of the embodiment shown in FIG. 4 and 4a is shown in FIG. 3 and comprises releasing surface 80 and clamping surface 82. The distance between clamping surfaces 80 is less than the distance between the clamping surfaces 82.

Moreover, a sill 70 and 72 comprised of plastic or the like are connected to the upper surface 74 and 76 of stringers 24 and 26 so as to bar access to, or hide the rotatable cam 50. In this way, fans or other viewers of the sport will not easily or accidentally contact the rotatable cam which may result in injury or cuts.

The operation of the rotatable cam 50 depicted in FIG. 4 and 4a shall now be described. The cam 50 includes first releasing surfaces 80 and if rotated to the point shown in FIG. 4, the releasing surfaces 80 will be adjacent the second leg 44 so as to permit removal of the panel 6. Upon further rotation by ninety degrees of rotatable cam 50, clamping cam surface 82 will contact the second leg 44 of U-shaped channel so as to pinch or clamp the panel in place. The rotatable cam is moveable by rotation of the hex head 58. The cam bracket 61 of FIG. 4 properly locates the shaft 54 and assists in the proper spacing of cam head 52. The sleeve or pipe 60 of FIG. 4a accommodates proper spacing of the cam head 52 from the cam bracket 62. In other words, the cam bracket 61 of FIG. 4 and aluminum sleeve 30 of FIG. 4a ensures that the the clamping or pinching force is provided near the upper ends of the legs 42 and 44 near the sills 70 and 72 so as to maximize the clamping force. Moreover, the rotatable cam 50 is designed to lock the cam in the clamping position in view of the flat edges 82. In other words as the rotatable cam rotates about the rounded edges, the relatively large, flat clamping surfaces 82 are presented next adjacent the moveable leg 44 so as to produce a positive clamping force. In other words legs 44 in FIG. 4 and 4a will move to the left in the locking position. If a U-shaped bracket is used as shown in FIG. 6 and 6a the 90 degree rotation of cam head 52 will cause the clamping surface 82 to bear against leg 44 and move same so as to close the 0.89 degree angle and pinch the tempered glass between the legs 42 and 44. The cam head 52 can be made of a suitable plastic such as such as sold under the trademark DELRIN™.

FIGS. 2 and 4 further illustrates the cam head 52 which is rotated in an unlocked position and then rotated 90 degrees to a locked position. In the locked position one locking surface 82 bears against the surface 45 of leg 44 while the other locking surface 82 of cam head 52 bears against the surface 27 of stringer 26. The same relationship is also found in the embodiment shown in FIG. 4a.

FIG. 8 is a perspective view of a rotatable cam assembly 100 which comprises an L-shaped plate which defines a moveable pressure plate 102 and lower plate 104. Lower plate 104 includes fastener securing holes 106 which are adapted to receive fastening means such as a screw 108. Other fastening means could be used. Lower plate 104 could include a number of holes but preferably would consist of two holes 106. The lower plate 104 is adapted to be removably fastened to the lower horizontal portion of stringer 26.

The rotatable cam assembly includes an L-shaped support bracket 110 which includes a top support locating surface 112 and vertical surface 114. Top support surface 112 and lower plate 104 each include aligned holes 116 and 118 respectively for receiving threadless bolt or shaft 54. L-shaped support bracket 110 is connected to lower plate 104 by any suitable means such as welding 119 or the like.

Lower plate 104 includes a peripheral edge 120. The distance between peripheral edge 120 and vertical surface 112 as shown in FIGS. 9 and 10 is sufficient for vertical surface to butt up against stringer 26 when screws 108 have fastened rotatable cam assembly 100 to stringer 26. The rotatable cam assembly 100 includes a shaft 54 having hex head 58. The other end of shaft 54 has fastened thereto a circular head defining a cam 130 where axis of rotation R is eccentric to that of the axis of rotation S shaft 54. Cam head 130 may be fastened to the end of shaft 54 by a number of means including welding, in which case cam head 130 can comprise a hollow circular sleeve which is eccentrically welded to shaft 54.

The cam head 130 is adapted to be rotated by hex head 58 from the unlocked position shown in FIG. 9 to the locked position shown in FIG. 10, by rotating the shaft 54 180 degrees. In the locked position shown in FIG. 10 circular cam head 130 bears against pressure plate 102 which is adapted to pivot about fold line 132 and press against leg 44 of U-shaped channel 40 in a manner so as to fasten shielding panel 6 to the U-shaped channel 40.

Although the U-shaped channel can be made from a number of materials, aluminium is often used because of its light weight. However, aluminium tends to be soft, and when using the cam surface shown in FIG. 4 and 4a may wear particularly if the cam head is repeatedly rotated from a locked to an unlocked position. In other words leg 44 may exhibit a slight hollow or depression (not shown) caused by the imprint of rotatable head 50. If a harder material such as steel is used for the U-shaped channel the formation of the said hollow or depression is less pronounced over time.

The cam assembly 100 may be made from any suitable material such as steel or the like including aluminium. However in one embodiment the cam assembly 100 is made from steel; that is L-shaped plates 100 and 110 including shaft 54 and rotatable head 130 are made from a suitable steel. Accordingly the cam assembly 100 wears well. Furthermore the cam assembly may be fastened by screws to aluminium stringer 26 thereby avoiding problems which would result in trying to weld steel to aluminium. Since the pressure plate 102 has a larger area than the cam head 130 pressure may be exerted over a larger area over U-shaped channel 40 thereby providing positive locking force. Furthermore since the pressure is exerted by pressure plate 102 over a larger area over U-shaped channel 40 there is less wearing and thereby minimizing the formation of the slight hollow or depression in the U-shaped channel 40.

The dasher boards are adapted to be connected in side by side fashion whereby the side plate 36 of one dasher board system is adapted to be connected to the side plate 38 of the next adjacent dasher board 2. The dasher board 2 is generally constructed in a straight planer manner as shown in FIGS. 1, 2 and 2a particularly when such dasher board 2 comprises the straight portion of a hockey rink such as between the blue lines. When the dasher board 2 defines a curved portion such as between the blue lines in the end of a hockey rink the straight planer portions of dasher board 2 may be utilized but more preferably a curved dasher board 2 such as shown in FIGS. 5 and 7. The curved dasher board 2 is constructed in a similar fashion as that described above and includes spaced stringers 24 and 26, flat plates 28 which are welded to the stringers 24 and 26. When a curved dasher board 2 is utilized stringer 24 may be narrower than stringer 26. For example, stringer 26 may comprise a one and one-half inch by four inch by 3/16 of an inch aluminium tube while stringer 24 comprises a one inch by four inch by 0.120 inch aluminium tube stringer. The distance between the face 43 of leg 42 and surface 25 of stringer 24 varies along the curved dasher board 2. The U-shaped channel 40 is welded to plate 28 while the top end of leg 42 bears against the top sill 70. A flat bar spacer 49 may be required to be connected or welded to the stringer 26 so as to provide a bearing surface for contact with the locking surface 82 of cam 50. FIG. 5 also illustrates that some of the plates 28 are welded over the posts 16 and 18 while other plates 28 include an aperture 51 for accommodating the cam assembly 50.

The dasher board 2 also includes a pair of clips 81 which are welded to the channels 12*a* and 12*b*. The clips 81 are also welded to the posts 16 and 18. Accordingly, the dasher board 2 as described herein may be assembled in side by side relationship by utilizing the straight and curved dasher boards 2 as described herein so as to define an athletic surface such as a hockey rink or the like. The dasher board 2 includes a channel having a fixed leg and a movable leg said movable leg movable or displaceable by a displaceable means such as a cam as described herein.

Although the preferred embodiment as well as the operation and the use have been specifically described in relation to the drawings, it should be understood the variations in the preferred embodiment could be achieved by a man skilled in the art without departing from the spirit of the invention. Accordingly, the invention should not be understood to be limited to the exact form revealed by the drawings.

The embodiments of the invention in which an exclusive property or privilege is claimed are defined as follows:

1. A dasher board assembly comprising:

a channel for receiving a shielding panel;

a rotatable cam cooperating with said channel adapted to releasably clamp said shielding panel to said channel;

a lower frame adapted to be anchored to the ground extending upwardly towards a pair of spaced apart stringers, said channel comprising a U-shaped cross-section disposed between said stringers, said lower frame comprising a bottom plate adapted to be anchored to the ground with a plurality of spaced apart up-standing posts, each of said posts comprising a lower end connected to said bottom plate and an upper end connected to said stringers; and a flat plate disposed between said stringers, said channel and said upper end of said posts connected to said flat plate.

2. The dasher board assembly of claim 1, wherein said flat plate is welded to said stringers, said channel and said upper ends of said posts.

3. The dasher board assembly of claim 2, wherein said channel comprises a first leg and a second leg, and wherein said first leg is welded to one of said stringers, and said second leg is displaceable and adapted to be contacted by said rotatable cam.

4. The dasher board assembly of claim 3, wherein said rotatable cam is pinned to a bolt and comprises a cam head.

5. The dasher board assembly of claim 4, wherein said cam head is comprised of plastic.

6. The dasher board assembly of claim 5, wherein said rotatable cam comprises an aluminum pipe.

7. The dasher board assembly of claim 6, comprising a sill to prevent access to said rotatable cam.

8. The dasher board assembly of claim 1, wherein said shielding panel further comprises tempered glass.

9. A dasher board assembly comprising:

(a) a lower frame comprising (i) a bottom plate adapted to be anchored to the ground;

(ii) a pair of spaced apart stringers at an upper end of said lower frame, said stringers comprising an upper and lower surface;

(iii) a plurality of upstanding posts, each comprising a lower end connected to said bottom plate and an upper end connected to said lower surface of a respective stringer;

(b) a U-shaped channel disposed between said stringers, said U-shaped channel comprising a first leg connected to one of said stringers and a second movable leg spaced from said other stringer;

(c) a shielding panel adapted to be releasably secured to said U-shaped channel;

(d) a rotatable cam disposed between said second leg of said U-shaped channel and said other stringer for cooperating with said second leg of said U-shaped channel to releasably clamp said shielding panel between said first and second legs; and (e) a sill connected to said upper surface of said stringers to prevent access to said rotatable cam, said rotatable cam is pinned to a bolt and comprises a cam head.

10. The dasher board assembly of claim 9, comprising a flat plate secured to said bottom surface of said stringers, said flat plate comprising an aperture adapted for receiving said rotatable cam.

11. The dasher board assembly of claim 10, further comprising a cam bracket secured to said other stringer, said cam bracket comprising an aperture for receiving a rotatable shaft, said rotatable shaft comprising said rotatable cam at one end thereof.

12. The dasher board assembly of claim 11, wherein said lower frame further comprises a pair of side plates at each side of said dasher board assembly, welded to said stringers and said bottom plate.

13. The dasher board assembly of claim 12, further comprising a plurality of frames connected in side by side fashion to define an athletic enclosure.

14. The dasher board assembly of claim 13, wherein said side plates of said plurality of frames are connected in side by side fashion.

15. The dasher board assembly of claim 9, wherein said shielding panel further comprises tempered glass.

* * * * *